United States Patent [19]

Cosyns et al.

[11] 4,208,271

[45] Jun. 17, 1980

[54] PROCESS FOR THE SELECTIVE HYDROGENATION OF GASOLINES COMPRISING BOTH GUM-GENERATING COMPOUNDS AND UNDESIRABLE SULFUR COMPOUNDS

[75] Inventors: Jean Cosyns, Maule; Michel Derrien, Rueil Malmaison, both of France

[73] Assignee: Institut Francais du Petrole, Rueil-Malmaison, France

[21] Appl. No.: 964,393

[22] Filed: Nov. 29, 1978

[30] Foreign Application Priority Data

Nov. 29, 1977 [FR] France ..... 77 36221

[51] Int. Cl.[2] ..... C10G 23/04

[52] U.S. Cl. ..... 208/255; 208/189

[58] Field of Search ..... 208/210, 255, 57, 143, 208/189

[56] References Cited

U.S. PATENT DOCUMENTS

| | | | |
|---|---|---|---|
| 3,470,085 | 9/1969 | Parker | 208/143 |
| 3,770,619 | 11/1973 | Derrien et al. | 208/255 |
| 3,846,278 | 11/1974 | Sze et al. | 208/57 |

*Primary Examiner*—George Crasanakis

*Attorney, Agent, or Firm*—Millen & White

[57] ABSTRACT

Unsaturated gasolines of both high mercaptan or hydrogen sulfide content and high gum-generator content are hydrogenated first over a palladium catalyst and then over a nickel catalyst. Resultant unsaturated gasolines are sweet and have low gum-generator content.

12 Claims, No Drawings

PROCESS FOR THE SELECTIVE HYDROGENATION OF GASOLINES COMPRISING BOTH GUM-GENERATING COMPOUNDS AND UNDESIRABLE SULFUR COMPOUNDS

This invention concerns a process for selectively hydrogenating gasoline containing both gum-generating compounds and undesirable sulfur compounds, particularly mercaptans and/or hydrogen sulfide.

Pyrolysis or cracking processes, particularly steam-cracking of such hydrocarbon charges as gasolines or naphthas, are known to simultaneously produce olefins, particularly ethylene, and gasolines. It is also known that such gasolines are unstable, as a result of the presence of gum-generating compounds, and that they can be stabilized by hydrogenation in the presence of a catalyst, for example nickel metal or palladium metal, or alternatively sulfided cobalt molybdate.

Now, in view of the high price of crude oil or straight-run cuts, the operators of pyrolysis units, particularly those of steam-cracking units, are obliged to use heavier and heavier feedstocks, such as gas oil, instead of naphtha or gasoline which were the sole feedstocks up to now. This results in an increase of the sulfur compound content in the resultant gasolines, particularly the content of mercaptans which strongly poison the hydrogenation catalysts, particularly the metal catalysts. The increased severity of steam-cracking necessary to improve the ethylene production has also led to an increased production of gum-generating compounds such as diolefins and styrenic and indenic compounds. These two particularities make the hydrogenation of these gasolines difficult. It is also noticeable that, for use as motor fuel, gasoline must be freed from at least the major part of the mercaptans, so as to give a negative result in the plumbite test (Doctor Test).

It is thus essential that the hydrogenation of gum-generating compounds also result in the sweetening of gasoline. The processes now available operate usually with catalysts comprising Pd or Ni metal on a carrier. In some cases, use is made of supported catalysts of the Co-Mo, Ni-Mo or Ni-W type in the sulfided state. These catalysts have commonly too low an activity for the treatment of pyrolysis gasolines of very high diolefinic, styrenic and indenic content. Nickel has also often too low an activity in the case of gasolines having a high content of both gum-generating compounds and mercaptans. Palladium has a high hydrogenation activity but also the disadvantage of not sweetening such gasolines, which means that the mercaptan content is not sufficiently decreased or is even increased in some cases by hydrogenation which makes these gasolines unsuitable as motor fuels.

Another problem is that of the pyrolysis or cracking gasolines, for example steam-cracking gasolines which, in addition to gum-generating compounds, and irrespective of the presence or absence of mercaptans, contain dissolved hydrogen sulfide, for example 2 parts per million by weight, or more, for example 5 ppm or more, in spite of the conventional fractionation to which they are subjected. Here again the conventional catalysts are unsatisfactory: with palladium, the total amount of sulfur does not substantially decrease while the mercaptan content often increases; with nickel, progressive deactivation of the catalyst, as concerns the hydrogenation of gum-generating compounds, is observed.

The process of this invention obviates all these disadvantages. It consists of hydrogenating gasoline, by means of hydrogen gas, in two distinct catalyst beds. Gasoline and hydrogen are first passed over a catalyst comprising supported palladium metal, and then over a catalyst comprising supported nickel metal, under conventional operating conditions of gasoline selective hydrogenation, i.e. conditions ensuring at least a partial removal of mercaptans and hydrogen sulfide and at least a partial hydrogenation of the gum-generating compounds (made apparent through lowering of the maleic anhydride value or MAV) without excessive hydrogenation of the monoolefins (decrease of the bromine number by less than 35%, preferably less than 20% of the initial value).

These conventional conditions are well known. They include the following conditions, given by way of non-limitative example:

- temperature: 30°–250° C., preferably 50°–200° C.;
- total pressure: 10–100 bars, preferably 20–50 bars;
- space velocity or ratio of the volume of liquid charge (gasoline) to the volume of catalyst per hour (VVH) of 0.5–10, preferably 2–5;
- molar ratio of hydrogen to the feedstock (gasoline): 0.1 to 2, preferably 0.5 to 1.5.

It is preferred to operate with fixed beds of catalyst which may be arranged behind each other or over each other, in the same reactor or in two or more distinct reactors.

Use of palladium metal or nickel metal is intended to mean that the reaction is started with palladium or nickel in the substantially reduced state, with the exclusion of the same metals entirely in the oxide or sulfide state. During the operation, the exact state of the catalyst is not known with certainty; a limited sulfiding, or a low sulfur adsorption may thus occur. Numerous studies have been devoted to these phenomena, so that it is unnecessary to describe them here.

The preferred catalyst carriers are the so-called neutral carriers, i.e. those having only a low acidity or no acidity at all, said acidity being measured, for example, according to the test of ammonia adsorption (Journal of Catalysis, 2, 211–222, 1963).

The acidity of the carriers used in the process may be measured by the heat of ammonia adsorption onto the carrier at a pressure of $10^{-4}$ mm Hg. The adsorption heat $\Delta H$ is given as:

$$\Delta H = \frac{\text{Heat released (cal. per gram of carrier)}}{\text{Adsorbed ammonia (millimol. } NH_3 \text{ per gram of carrier)}}$$

These two determinations are effected by thermogravimetry and differential thermal analysis at the temperature of use of the catalyst.

A carrier may be considered as substantially neutral when its $\Delta H$ is lower than 0.04, and slightly acidic when its $\Delta H$ is from 0.04 to 0.1.

The selection of the carrier is not an essential feature of the invention. Convenient carriers may be refractory oxides or other refractory compounds of metals from groups II, III and IV of the periodic classification, for example, silicates or oxides of these metals, preference being given to alumina, particularly alumina of specific surface from 30 to 150 $m^2/g$, preferably from 50 to 100 $m^2/g$.

The methods for manufacturing the catalysts are well-known in the art. They are thus not described here in greater detail.

The first catalyst bed amounts advantageously to 10–80% by weight of the total amount of catalyst and preferably to 15–40% of this amount. The second catalyst bed (or all subsequent beds) represent the complementary amount.

The first catalyst contains advantageously from 0.05 to 5% by weight of Pd, preferably from 0.1 to 0.5%.

The second catalyst may contain from 2 to 50% by weight of nickel and preferably from 5 to 20%.

The pyrolysis gasolines or hydrocarbon fractions to which the invention more particularly applies exhibit a maleic anhydride value (MAV) higher than 10 (mg/g) and in most cases higher than 20, and a mercaptan content (calculated as sulfur) usually of at least 10 (for example 20 to 250) parts per million by weight (they give a positive result in the plumbite test: Doctor Test) and/or a content of dissolved $H_2S$ (calculated as sulfur) of at least 2, preferably at least 5 parts per million by weight. Such gasolines may comprise more than 200 and often more than 500 ppm of total sulfur.

At least 80% of the components of these gasolines distill between 40° and 220° C., by way of example. It is however clear that lighter or heavier charges may benefit from treatment by the process according to the invention.

Particularly desired gasolines, which constitute an example of products to be obtained according to the invention, have a maleic anhydride value lower than 5, a mercaptan content lower than 10 parts per million by weight and give a negative result in the plumbite test (Doctor Test).

EXAMPLE 1 (comparison)

The charge to be treated has been recovered from a gas oil steam-cracking plant; it exhibits the following properties:

| PROPERTIES | METHOD | RESULTS |
|---|---|---|
| Specific gravity at 15° C. | NF T 60-101 | 0.859 |
| ASTM Distillation °C. | NF M 07-002 | |
| Initial point | | 55 |
| 50% | | 111 |
| Final point | | 180 |
| Total sulfur ppm b.w. | NF M 07-014 | 1500 |
| $H_2S$ sulfur ppm b.w. | | <2 |
| Mercaptan sulfur ppm b.w. | NF M 07-031 | 70 |
| Corrosion of a copper blade | NF M 07-015 | 1b |
| Plumbite test (Doctor Test) | NF M 07-005 | positive |
| Bromine number (g. Br/100 g) | NF M 07-017 | 52 |
| Maleic anhydride value (MAV) in mg maleic anhydride/g | UOP 326-58 | 97 |
| Induction period (mn) with 20 ppm antioxidant (N,N'-di-sec.butyl paraphenylene diamine) | NF M 07-012 | 20 |
| Research octane number (0.05% b.w. of tetraethyl lead) | NF M 07-026 | 98 |

This gasoline is passed, in admixture with hydrogen, through a reactor filled exclusively with a catalyst containing 0.3% b.w. of palladium deposited conventionally from palladium nitrate onto an alumina carrier of a 70 $m^2/g$ specific surface. The alumina acidity in the above test of ammonia adsorption is $\Delta H=0.03$. Before use, the catalyst is calcined at 450° C. for 2 hours and then reduced with hydrogen at 100° C. for 2 hours.

The operating conditions are as follows:

Space velocity vol/vol/h: 2

Average temperature °C.: 130

Total pressure (bars): 40

$H_2$/charge (moles): 0.5

The product obtained after 100 hours has the following main properties:

Bromine number (g/100 g): 40

MAV (mg/g): 2

Induction period (mn) with 20 ppm antioxidant: 540

Mercaptan sulfur (ppm b.w.): 100

Total sulfur (ppm b.w.): 1500

Corrosion of copper blade: 1b

Plombite test: positive

Research O.N.: 98

It is thus found that this catalyst is able to hydrogenate practically all gum-generating compounds (MAV=2); however it does not reduce (but, on the contrary, increases) the mercaptan content; the resultant gasoline cannot be used as motor fuel for cars.

The test is continued for 1000 hours and the same properties are found, taking into account the precision of the analyses.

EXAMPLE 2 (comparison)

The same gasoline as in example 1 is hydrogenated in a reactor exclusively filled with a catalyst containing 10% b.w. of nickel, which was deposited in a conventional manner from nickel nitrate onto a carrier identical to that of example 1, calcined at 500° C. for 2 hours and then reduced in hydrogen at 400° C. for 15 hours.

The operating conditions are the same as in example 1.

The product obtained after 100 hours of run has the following properties:

Bromine number g/100 g: 43

MAV mg/g: 10

Induction period (mn) with 20 ppm b.w. of antioxidant: 480

Mercaptan sulfur (ppm b.w.): 6

Total sulfur (ppm b.w.): 1500

Corrosion of copper blade: 1a

Plumbite test: negative

Research O.N.: 98

It is found that the hydrogenation of the gum-generating compounds is substantially lower than in example 1; it is in fact insufficient since the MAV required by the operators of such plants should be lower than 5.

On the contrary it is observed that the product has been sweetened as compared with the charge and complies with the standard for motor-fuels.

The test was continued for 1000 hours. The MAV of the hydrogenated product increased to 15, thus showing a substantial deactivation of the catalyst.

EXAMPLE 3 (according to the invention)

The same gasoline as in example 1 is now treated, in the presence of hydrogen, in a reactor comprising two catalyst beds. The first bed, which amounts to $\frac{1}{3}$ of the total catalyst volume, consists of the reduced palladium catalyst from example 1, and the second bed, which amounts to $\frac{2}{3}$ of the said total volume, consists of the reduced nickel catalyst from example 2.

The operating conditions are the same as in examples 1 and 2.

The results are given in Table I.

EXAMPLE 4 (comparison)

Example 3 is repeated, except that the nickel catalyst ($\frac{1}{3}$ of the total volume) now precedes the palladium catalyst bed ($\frac{2}{3}$ of the total volume), the catalysts and the operating conditions being unchanged. The results are given in Table I.

EXAMPLE 5 (according to the invention)

Example 3 is repeated, except that the respective proportions of the catalysts are: 15% by volume of palladium catalyst followed with 85% by volume of nickel catalyst. The other conditions are unchanged. The results are given in Table I.

EXAMPLE 6 (according to the invention)

Example 3 is repeated, except that the respective proportions of the catalysts are: 50% by volume of palladium catalyst followed with 50% by volume of nickel catalyst, the other conditions being unchanged. The results are given in Table I after 100 hours.

TABLE I

| EXAMPLES | 3 | 4 | 5 | 6 |
|---|---|---|---|---|
| Bromine number g/100 g | 42 | 41 | 45 | 41 |
| MAV mg/g | 3.5 | 2.5 | 4.8 | 2.7 |
| Induction period (mn) with 20 ppm b.w. of antioxidant | 500 | 540 | 480 | 530 |
| Mercaptan sulfur ppm b.w. | 7 | 20 | 4 | 9 |
| Total sulfur ppm b.w. | 1490 | 1500 | 1490 | 1500 |
| Corrosion of copper blade | 1a | 1a | 1a | 1a |
| Plumbite test | negative | positive | negative | negative |
| Research O.N. | 98 | 98 | 98 | 98 |

It is found that the sole products to satisfy both the MAV and mercaptan sulfur requirements and the plumbite test are those of examples 3, 5 and 6.

Experiment No. 3 was continued. After 1,000 hours, the standards were again satisfied: MAV=4.5; plumbite test: negative; mercaptan sulfur: 8 ppm b.w.

EXAMPLES 7 to 10

These examples concern the treatment of gasoline of relatively low mercaptan content, but containing dissolved hydrogen sulfide, as recovered from steam-cracking of naphtha.

Composition of the feedstock:
Specific gravity at 15° C.: 0.830
ASTM distillation °C.: 55–199
Total sulfur ppm b.w.: 310
Mercaptan sulfur ppm b.w.: 8
Dissolved $H_2S$ sulfur ppm b.w.: 10
MAV mg/g: 43
Bromine number g/100 g: 38
Plumbite Test: positive
The operating conditions are:
T=100° C.; total pressure: 30 bars; space velocity: 2 vol/vol/h; molar ratio $H_2$ /gasoline: 0.5
The catalysts are as follows:

| Example | Catalyst |
|---|---|
| 7 (comparison) | catalyst of example 1 |
| 8 (comparison) | catalyst of example 2 |
| 9 (invention) | 25% by volume of the palladium catalyst of example 1 followed with 75% by volume of the nickel catalyst of example 2. |
| 10 (comparison) | 75% by volume of the nickel catalyst of example 2 followed with 25% of the palladium catalyst of example 1. |

The tests are the same as above and the results are given in Table II.

TABLE II

| | AFTER 50 HOURS | | | AFTER 1000 HOURS | | |
|---|---|---|---|---|---|---|
| EXAMPLE | DT | R-SH | MAV | DT | R-SH | MAV |
| 7 | + | 18 | 1.5 | + | 18 | 2.5 |
| 8 | – | ≦5 | 5 | – | ≦5 | 15 |
| 9 | – | ≦5 | 3.5 | – | ≦5 | 4.5 |
| 10 | – | ≦5 | 3.5 | – | ≦5 | 12 |

DT = Plumbite test (result: + or –)
R-SH = mercaptan sulfur content (ppm by weight)
MAV (mg/g).

The only catalysts to give acceptable results after 50 hours of run are the catalysts of examples 8 to 10; however catalysts 8 and 10 deactivate strongly thereafter. Only the catalyst of example 9 remains stable as concerns both sweetening and hydrogenation.

What we claim is:

1. A process for the selective hydrogenation of gasoline contaning (a) mono-olefins, (b) gum-generating compounds, and at least 200 parts per million by weight of total sulfur, including at least 10 parts per million by weight calculated as sulfur of mercaptans or at least 2 parts per million by weight calculated as sulfur of hydrogen sulfide; said process comprising contacting gasoline with hydrogen at a temperature of 30° to 250° C. first with a supported palladium metal catalyst and then with a supported nickel metal catalyst; said contacting being conducted under such conditions that the gum-generating compounds are substantially eliminated and a sweetened gasoline is obtained without excessive hydrogenation of the monoolefins.

2. A process according to claim 1, wherein the temperature is from 50° to 200° C.

3. A process according to claim 1, wherein the gasoline to be treated has a maleic anhydride value of more than 10 mg/g and a mercaptan content, calculated as sulfur, of at least 10 parts per million by weight, said gasoline giving a positive result in the standard plumbite test.

4. A process according to claim 1, wherein the gasoline to be treated has a maleic anhydride value of more than 10 mg/g and a content of dissolved hydrogen sulfide, calculated as sulfur, of at least 2 parts per million by weight.

5. A process according to claim 1 wherein the catalysts are arranged in fixed beds.

6. A process according to claim 1, wherein the carrier for both catalysts is alumina having a specific surface from 30 to 150 $m^2/g$ and an acidity of lower than 0.4, as determined by the $\Delta H$ in the ammonia adsorption test.

7. A process according to claim 1, wherein the palladium catalyst and the nickel catalyst amount respectively to 10–80% and 90–20% of the total volume of catalyst.

8. A process according to claim 1, wherein the palladium catalyst and the nickel catalyst amount respectively to 15–40% and 85–60% of the total volume of catalyst.

9. A process according to claim 1, wherein the first catalyst comprises 0.05–5% by weight of palladium and the second catalyst 2–50% by weight of nickel, said percentages being based on the total weight of said catalyst.

10. A process according to claim 3, wherein the operating conditions are so selected as to yield gasoline of maleic anhydride value lower than 5 mg/g and mercaptan content, calculated as sulfur, lower than 10 parts per million by weight, said gasoline giving a negative result in the standard plumbite test.

11. A process according to claim 1, wherein the total effluent from the first catalytic step using the palladium catalyst is passed to the second catalytic step using the nickel catalyst without any intermediate separation.

12. A process according to claim 1, wherein the decrease in the bromine number of the resultant gasoline is less than 20% of the initial value.

* * * * *